US005627541A

United States Patent [19]

Haley et al.

[11] Patent Number: 5,627,541

[45] Date of Patent: May 6, 1997

[54] INTERFERENCE TYPE RADIATION ATTENUATOR

[75] Inventors: Donald D. Haley; Louis Maus, both of Tulsa, Okla.

[73] Assignee: Rockwell International Corporation, Seal Beach, Calif.

[21] Appl. No.: 743,260

[22] Filed: Jul. 8, 1968

[51] Int. Cl.[6] ..... H01Q 17/00

[52] U.S. Cl. ..... 342/1; 342/4

[58] Field of Search ..... 343/18 A, 18 B; 342/1, 2, 3, 4

[56] References Cited

U.S. PATENT DOCUMENTS

| | | | |
|---|---|---|---|
| 2,590,906 | 4/1952 | Tripp | 343/18 A |
| 2,717,312 | 9/1955 | Taylor | 343/18 A |
| 2,877,286 | 3/1959 | Vance et al. | 174/35 MS |
| 2,996,710 | 8/1961 | Pratt | 343/18 A |
| 3,300,781 | 1/1967 | Clough et al. | 342/3 |
| 3,315,261 | 4/1967 | Wesch | 343/18 A |
| 3,349,396 | 10/1967 | Reed | 342/3 |
| 3,349,397 | 10/1967 | Rosenthal | 342/3 |
| 3,431,348 | 3/1969 | Nellis et al. | 343/18 A |
| 3,453,620 | 7/1969 | Fleming et al. | 342/4 |
| 3,662,387 | 5/1972 | Grimes | 342/1 |
| 3,680,107 | 7/1972 | Meinke et al. | 342/1 |

FOREIGN PATENT DOCUMENTS

| | | | |
|---|---|---|---|
| 814310 | 6/1959 | United Kingdom | 343/18 A |

*Primary Examiner*—John B. Sotomayor

*Attorney, Agent, or Firm*—George A. Montanye; Harry B. Field; Steven E. Kahm

[57] ABSTRACT

An attenuator of electromagnetic radiation, such as radar, is described wherein a single attenuator sheet in the nature of "spacecloth" is placed in front of a plurality of reflective layers wherein each of the reflective layers is tuned to reflect a narrow band of radiation of a selected frequency and transmit other frequencies; and each of the reflective layers is spaced from the attenuation layer at a distance of one-fourth of the wavelength of electromagnetic radiation to which it is tuned. In a preferred embodiment each of the reflective layers comprises elongated narrow conductive areas arranged in spaced apart columns and rows in a generally non-conductive area.

16 Claims, 2 Drawing Sheets

Fig. 1
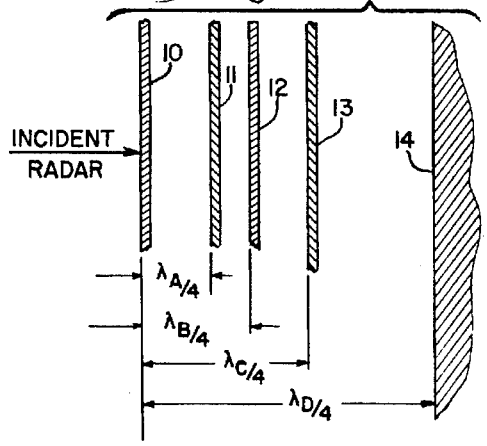
Fig. 2
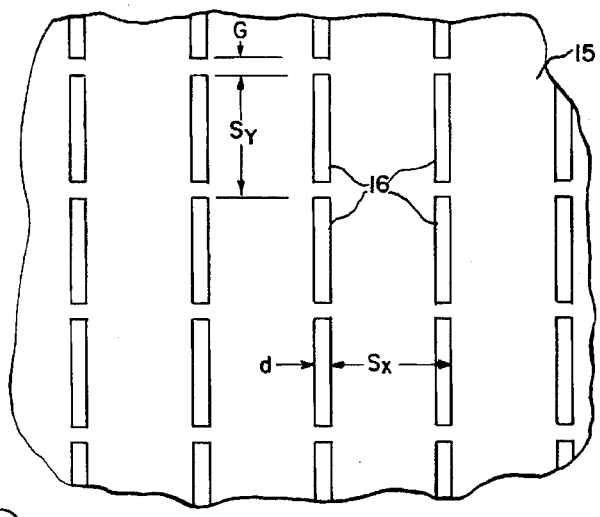
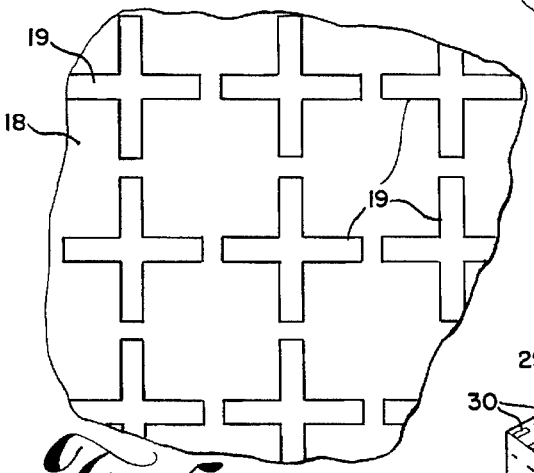
Fig. 5
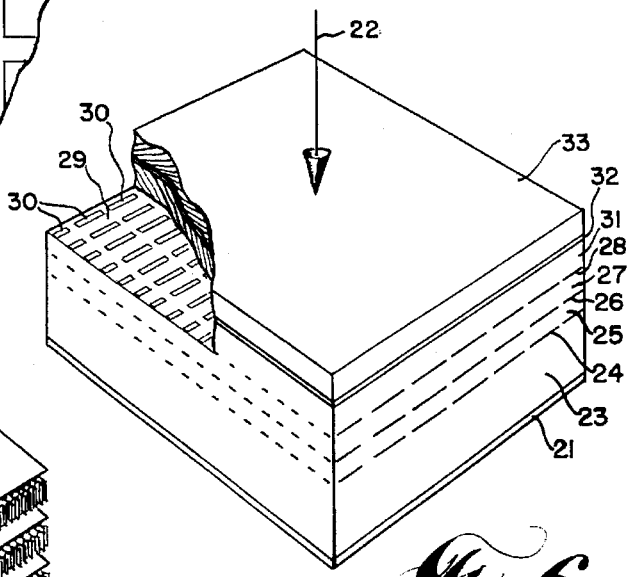
Fig. 6
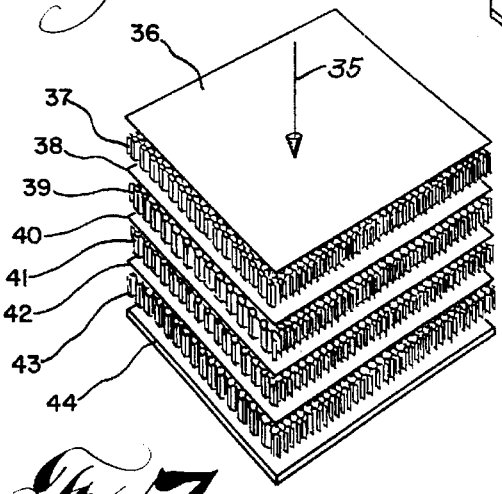
Fig. 7

INTERFERENCE TYPE RADIATION ATTENUATOR

BACKGROUND

Attenuation of radar energy impinging on a surface can be achieved by destructive interference. A radar wave reflected from a surface has a maximum electric field at one-quarter of its wavelength from the reflective surface. A resistive material placed at one-quarter wavelength from the reflective surface conducts current and reduces the energy of the maximum electric field, thereby attenuating the reflected radar wave. An example of this type of attenuator is the Salisbury screen wherein a thin layer of controlled conductivity (often known as spacecloth) is spaced from a reflective surface such as a metal sheet at a distance equal to one-quarter of the wavelength of the radar to be attenuated. The spacecloth conventionally has an impedance of approximately 377 ohms per square which is the characteristic impedance of free space. By having the impedance of the spacecloth substantially the same as that of free space no substantial reflection occurs therefrom.

As an improvement on the Salisbury screen the same principle is employed wherein a plurality of impedance layers having controlled electrical properties are spaced successively from a metal reflective surface with each of the sheets being a distance corresponding to one-quarter wavelength of radiation of a particular frequency. Since the attenuation of a single sheet interference absorber is actually over a narrow band rather than sharply at a specific frequency, and because of interaction between the successive layers in a multiple layer interference attenuator, there can be substantially continuous attenuation of radar over a relatively broad frequency range.

In order to obtain good attenuation over a broad frequency range it is necessary to carefully control the spacing between successive layers, the dielectric properties of the spacing material, and also the characteristic impedance of each of the layers. When a plurality of impedance layers are employed substantial quality control problems are encountered in achieving the desired impedance values in all of the attenuator layers. A typical interference type absorber as provided in the prior art is described and claimed in copending U.S. patent application Ser. No. 305,564 entitled, "Multilayer Structure" by L. J. Costanza et al, and assigned to North American Rockwell Corporation, the assignee of this application.

Control of the electrical properties of attenuator layers at nominal temperatures is severe enough. However, the problem is particularly acute at elevated temperatures where the materials available for producing a good interference type attenuator are limited in number and are difficult to handle.

It is therefore desirable to produce a radar attenuator wherein the requirement for precise control of impedance of a plurality of layers is minimized or eliminated.

SUMMARY OF THE INVENTION

Thus, in the practice of this invention, according to a preferred embodiment, there is provided an attenuator of electromagnetic radiation comprising an electrically thin attenuator layer having substantially the same impedance as free space and a reflective layer therebehind tuned to reflect a selected frequency of electromagnetic radiation and transmit other frequencies, said reflective layer being spaced from the impedance layer at a distance of one fourth of the wavelength of electromagnetic radiation to which the reflective layer is tuned. If desired, an additional plurality of reflective layers may be spaced from the impedance layer on the same side as the first reflective layer. Each of the additional reflective layers is tuned to reflect a selected frequency of radiation and be transparent to other frequencies, and is spaced from the impedance layer at a distance of one fourth of the wavelength of radiation to which it is tuned.

Objects and many of the attendant advantages of this invention will be readily appreciated as the same becomes better understood by reference to the following detailed description when considered in connection with the accompanying drawings wherein:

BRIEF DESCRIPTION OF THE DRAWINGS

FIG. 1 is a schematic section of an interference attenuator constructed according to the principles of this invention;

FIG. 2 comprises a view of a portion of one of the reflective layers of FIG. 1;

FIG. 5 comprises another arrangement of conductive areas in a reflective layer;

FIG. 6 comprises a cutaway perspective of a particular attenuator as provided in the practice of this invention; and FIG. 7 comprises an exploded view of an alternative arrangement for a radiation attenuator.

Throughout the drawings like reference numerals refer to like parts.

DETAILED DESCRIPTION OF THE INVENTION

Figure 3:
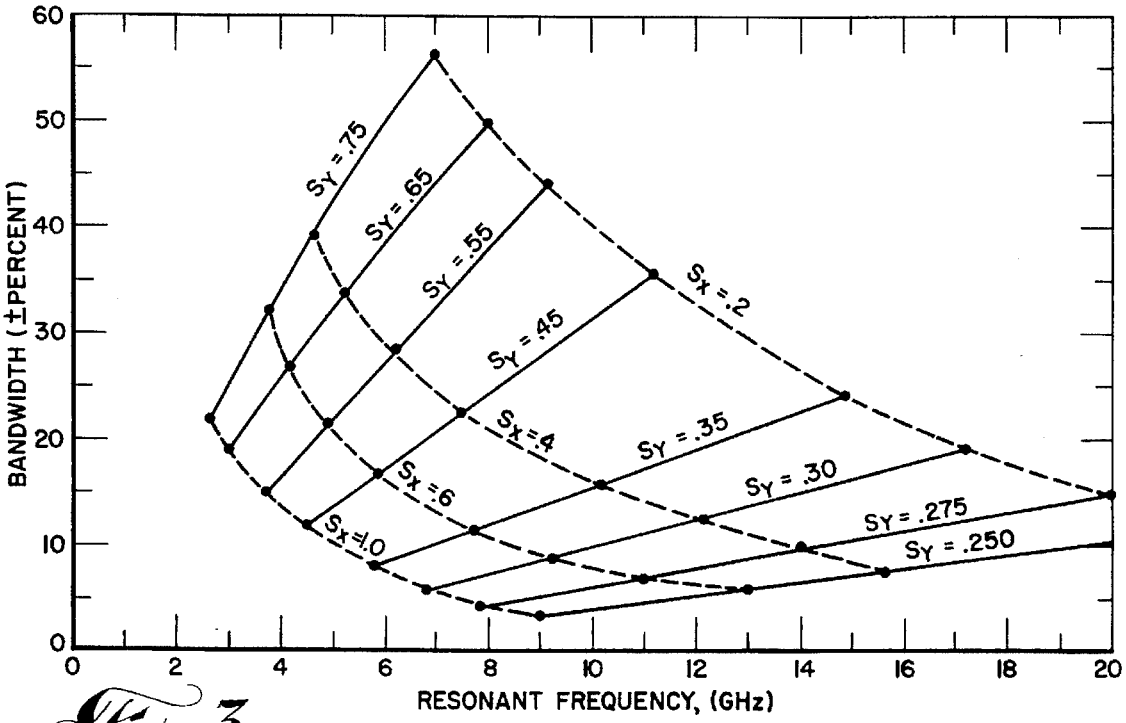
FIGS. 3 and 4 comprise graphs of bandwidth versus frequency for selected dimensions of a reflective layer as illustrated in FIG. 2.

FIG. 1 illustrates schematically a radar attenuator incorporating the principles of this invention. As illustrated in this embodiment there is provided an attenuator sheet or absorber sheet 10 which may, for example, comprise conventional "spacecloth" having a resistivity of about 377 ohms per square. Spacecloth is a commercially available material usually in the form of a fabric coated with a resin in which graphite or other carbon particles are dispersed for producing an impedance, at radar frequencies, of about 377 ohms per square. This impedance is employed since it is the characteristic impedance of free space (or air) and radar impinging thereon has no appreciable impedance mismatch and no appreciable radar reflection occurs. Spacecloth of this impedance is customarily used in Salisbury screen and related radar and microwave attenuators. As used herein, "radar frequencies" include microwave and communication bands which behave in substantially the same manner as radiation in bands customarily used for radar applications.

Spaced behind the attenuator sheet 10, as viewed in the direction of an incident radar beam, is an electrically thin reflective layer 11, hereinafter more fully described, which is tuned to be reflective to a selected frequency of radiation having a wavelength of $\lambda a$ and substantially transparent to other frequencies. The reflective layer 11 is spaced from the attenuator sheet 10 at a distance of $\lambda a/4$ so that any radiation of wavelength $\lambda a$ reflected from the reflective layer 11 has a maximum electric field at the attenuator layer 10 and is absorbed by the attenuator layer in exactly the same manner as a conventional Salisbury screen having a metal sheet and a layer of spacecloth at $\lambda/4$. Although not illustrated in FIG. 1, it will be apparent that the layers 10 and 11 can be spaced apart in a rigid frame or by a conventional glass fabric honeycomb, or other means readily applied by one skilled in the art.

A second reflective layer 12 is spaced behind the first reflective layer 11 on the opposite side thereof from the attenuator layer 10. The second reflective layer 12 is tuned to reflect a frequency of radiation having a wavelength of λb and transmit other frequencies of radiation, and is spaced from the attenuator layer 10 at a distance of λb/4. The wavelength λb is longer than the wavelength λa. Thus, any radiation having a wavelength of λb reflected from the second reflective layer 12 is absorbed by the attenuator sheet 10 in the same manner as radiation reflected from the first reflective layer 11 or in a conventional Salisbury screen.

It is a characteristic of the reflective layer 11, as pointed out in greater detail hereinafter, that it is tuned to reflect a narrow frequency band spanning a center frequency having a wavelength λa. Radiation having a frequency outside this bandwidth is transmitted through the reflective layer 11 without any substantial effect thereon. Thus, radiation having a wavelength of λb incident on the radar attenuator of FIG. 1 is transmitted through the attenuator sheet 10 without reflection since this sheet has substantially the same impedance as free space. The radiation of wavelength λb is also transmitted through the first reflective layer 11 since the radiation has a frequency different from the frequency for which the reflective layer 11 is tuned to be reflective. The radiation with a wavelength of λb is then reflected from the second reflective layer 12, passes back through the first reflective layer 11 which is effectively transparent thereto, and is absorbed by the attenuator layer 10 which is spaced at λb/4 to intercept the reflected standing wave.

A third tuned reflective layer 13 is spaced behind the attenuator sheet 10 and the first and second reflective layers 11 and 12, respectively. The third reflective layer is tuned to reflect a frequency of radiation having a wavelength of λc and is spaced behind the attenuator layer 10 a distance of λc/4. The wavelength λc is obviously longer than either λa or λb. Thus radiation having this wavelength passes through the first, and second reflective layers which are transparent thereto, and is reflected from the third layer for absorption by the attenuator sheet 10 in substantially the same manner hereinabove described. It will be apparent that, if desired, additional tuned reflective sheets can be provided behind the attenuator layer with each of the additional reflective layers tuned to reflect a selected frequency and spaced behind the attenuator layer 10 a distance corresponding to one-fourth of the selected wavelength so that effective attenuation is obtained for additional selected frequencies.

Behind the several tuned reflective layers 11, 12 and 13, there is provided a continuous metal ground plane 14 which is reflective to substantially all frequencies of radiation and which is spaced behind the attenuator sheet 10 at a distance of λd/4. Thus, any radiation having a wavelength of λd passes through all of the intervening tuned reflective layers and is reflected by the metal ground plane for absorption by the attenuator sheet in substantially the same manner as in a conventional Salisbury screen. It will be apparent that the spacing between the reflectors and the attenuator is λ/4 for the wavelength of radiation in the material between the layers. If this material has electrical properties different from the properties of free space, the wavelength will be different from the wavelength in free space.

Thus, it will be apparent that with a radar attenuator as illustrated schematically in FIG. 1, radar attenuation occurs at a series of selected frequencies having successively greater wavelengths of λa, λb, λc, and λd so that with an attenuator of this type, reduction of radar echo is obtained over a substantial frequency range. It might appear on first consideration that sharp peaks of attenuation would be obtained at intermediate frequencies in the broad band; however, as is pointed out hereinafter, the reflection actually achieved by the reflective layers, 11, 12 and 13, is not all precisely at the wavelength for which it is tuned, but is a maximum at that wavelength and reflection actually occurs over an appreciable bandwidth on either side of the tuned resonant frequency. Because of overlap of the frequency ranges which may be obtained in a practical structure and some interaction between reflective layers in such an attenuator, the actual attenuation at the peaks may be reduced and the attenuation in the "valleys" between the absorption peaks may be increased to provide good attenuation over a broad frequency range extending from a frequency somewhat below that having a wavelength of λd, and to a frequency above that having a wavelength of λa.

REFLECTIVE LAYERS

Each of the tuned reflective layers 11, 12, and 13 is, in a preferred embodiment, formed of a generally nonconductive material having an array of a plurality of elongated narrow conductive areas thereon arranged in spaced apart columns and rows. Thus, for example, as illustrated in FIG. 2 the nonconductive layer may comprise a thin sheet of plastic 15 on which are formed narrow bars or areas of metal 16. The plastic sheet may comprise, for example, a film of oriented polyethylene terephthalate (available under the trademark Mylar from E. I. duPont de Nemours Company) and the metal bars may comprise a thin layer of aluminum or other metal vacuum metallized, sputtered, or printed on the Mylar sheet. The thickness of the conductive bars 16 should be greater than the skin depth for conductivity at the selected frequency for maximum reflection of radiation.

The frequency at which a reflective layer is reflective and the sharpness of the reflective peak is determined by the spacing and shape of the conductive areas 16. In the rectangular conductive bars illustrated in FIG. 2, four dimensions are of significance, namely: the center-to-center spacing $S_x$ in a first or x direction transverse to the length of the conductive bars; the width d of the conductive bars; the center-to-center spacing $S_y$ in a second or y direction along the length of the conductive bars; and the spacing G between the ends of adjacent bars. It is apparent that the length of the bars is $S_y$–G; however, the spacing G is preferably employed to define the geometry of the reflective array since it happens to be more readily employed in mathematical analyses of such arrays.

In the design of radomes or similar structures for transmitting electromagnetic radiation, it has been known in the past that a metal sheet or similar conductor with an array of non-conductive elongated slots or slits is transparent to radiation at a selected frequency and is opaque to radiation at other frequencies. The power transmitted through such a slotted sheet is a maximum at a frequency dependent on the geometry of the array of slots and diminishes on either side of the resonant or center frequency in a bell shaped curve somewhat like a "probability" curve although it may not be symmetrical but may be skewed to one side depending upon the geometry of the array.

It has been found that Babinet's principle from the field of optics can be applied to the field of electromagnetic radiation of radar frequencies, thus the mathematical treatment for the structure illustrated in FIG. 2 having a plurality of spaced conductive bars in a non-conductive field can be handled mathematically in a manner identical to the complementary structure of a slotted metal sheet. The result is that the reflected power versus frequency curve for an array of metal bars is the same as the power transmitted versus frequency curve for a slotted metal sheet. Thus the considerable analytical background available from the study of antenna covers, or radomes, is directly applicable to mathematical analysis of resonant or tuned reflectors employed in an attenuator as provided in the practice of this invention.

In order to fabricate a radar attenuator having absorption over a broad band of frequencies the bandwidth of each of the separate reflectors in the composite structure (such as illustrated in FIG. 1) is of interest as well as the center or resonant frequency for which the reflector is most reflective. The absorption of a multiple reflector attenuator as a function of frequency will depend on the number of tuned reflectors behind the spacecloth layer, the center frequencies of the reflectors, and their bandwidth. As briefly mentioned hereinabove, the power reflected from such an array of parallel bars is not all at a given frequency but is a bell shaped curve on a plot of reflected power versus frequency. A convenient arbitrary measure of frequency bandwidth widely used is bandwidth at the fifty percent power point or what is sometimes referred to as the three db-down point. This is the width of the power versus frequency curve at a level where the power reflected is fifty percent of the peak power reflected. The unit of measure employed is plus or minus percentage of frequency. That is, the mean difference between the minimum frequency at 50% power and the maximum frequency at 50% power as compared to the center or resonant frequency.

At any particular desired resonant frequency for a reflector there are a variety of dimensions of arrays of parallel conductive areas which will have reflection bands which center on the desired resonant frequency, and the bandwidths for these reflectors will depend on the dimensions of the array. If an individual reflective layer has an excessive bandwidth the attenuation of reflected radiation therefrom is diminished as the reflected wavelength deviates by greater amounts from the $\lambda/4$ spacing of the reflector from the spacecloth. On the other hand, a reflector with a narrow bandwidth has substantially all of the reflected power close to the $\lambda/4$ wavelength and good attenuation is obtained over the narrower band. In a multiple reflector attenuator a large number of narrow band resonators increases the cost and manufacturing difficulties and some electrical interaction between closely spaced tuned reflectors may be noted. Optimum attenuation is normally obtained with a few tuned reflectors having a moderate band-width.

It is found that a bandwidth of about ±10 to ±25% is preferred for the individual reflective layers. If the bandwidth of the layers is less than about ±10% an undue number of reflective layers is needed for broad band absorption even though the absorber is operable. If on the other hand, the bandwidth is broader than about ±25% the total attenuation obtained from the absorber is decreased due to both the failure of much the reflected radiation to have its maximum electric field at the attenuator layer which is spaced at exactly $\lambda/4$ from the reflector only for the resonant frequency, and an interaction between the multiple reflectors when the bands of the reflectors overlap any substantial amount. If the bandwidth is too broad, the peak power coefficient is also decreased, that is, the power reflected at the resonant frequency is decreased below 100% of the power of that frequency incident on the reflector. It is found that with a bandwidth of ±10% the peak power reflected is about 95% of the power at the peak frequency. Similarly at a bandwidth of ±20% the peak power reflection is about 88% to 90% and at a bandwidth of ±25% the peak power is only about 80 to 85%. At broader bandwidths the peak power falls off rapidly, thereby further degrading the performance of the attenuator.

Figure 4:
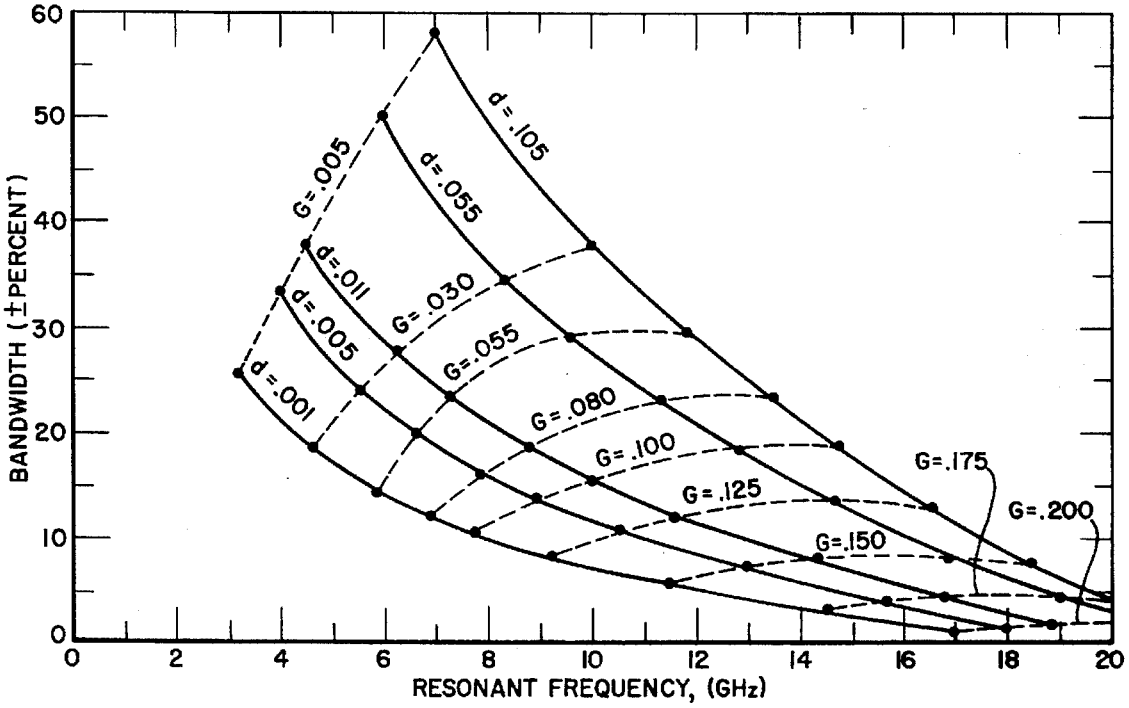

As mentioned hereinabove, a number of different geometries of reflective arrays will give resonance as a selected frequency. Bandwidth of the resonator is, however, affected by the dimensions selected. FIGS. 3 and 4 are graphs of percentage bandwidth versus resonant frequency obtained from parallel bar arrays having selected dimensions. In FIG. 3 the width d of the conductive area is selected at 0.005 inch and the gap G between the ends of successive conductive areas is selected as 0.125 inch. With these dimensions the spacings $S_x$ and $S_y$ for the conductive areas are selected for any given frequency and bandwidth. Thus, for example, if one desires a resonator having a center frequency of about 12 GHz (GigaHertz or $10^9$ cycles per second) and a bandwidth of ±12½% it is seen from FIG. 3 that the center-to-center spacing $S_x$ between adjacent rows of conductive areas is 0.4 inch and the center-to-center spacing $S_y$ along each row is 0.30 inch. It is apparent that other frequencies and bandwidths can be selected and the spacings between the adjacent conductive areas selected from the graph of FIG. 3.

FIG. 4 holds the spacing of conductive areas constant and shows the width and gap dimensions that will give a selected bandwidth at a desired frequency. Thus, in FIG. 4, $S_x$ is held constant at 0.5 inch and $S_y$ is held constant at 0.3 inch. It can be seen, for example, from FIG. 4 that if one desires a resonant frequency of about 6.7 GHz and a bandwidth of ±20% a resonator having these properties is formed with a conductive area having a width d of about 0.005 inch and a gap G between adjacent conductive areas of about 0.055 inch. It will be apparent that other values of frequency and bandwidth can be selected and the dimensions of the conductive areas determined by interpolation from the graphs of FIGS. 3 and 4. It will also be apparent that other similar families of curves may be constructed for other dimensions of arrays of conductive areas using emperical measurements or applying the mathematical relations for slotted sheet band pass structures.

The resonant reflectors described and illustrated to this point comprise single arrays of elongated narrow conductive areas in parallel rows and columns and it will be apparent without extensive consideration that such structures are polarized and are hence reflective for radiation similarly polarized with the degree of reflection diminishing for non-polarized radiation and radiation polarized in other directions in a well-known manner. In many circumstances it is desirable to provide a reflector substantially insensitive to polarization of radiation incident thereon and such a polarization insensitive reflector is readily provided by having a second array of elongated narrow conductive areas arranged transverse to the first array of narrow elongated conductive areas.

A specific example of a reflector that is insensitive to polarization is illustrated in FIG. 5 wherein a generally non-conductive area of a sheet 18 has a plurality of conductive cruciform areas 19 arrayed thereon. The array of cruciform conductive areas 19 can be considered as two arrays of elongated narrow conductive areas with the elements of one of the arrays being common with no more than one each of the elements of the other arrays. It is convenient to arrange these mutually perpendicular arrays in the form of crosses; however, it will also be apparent that a polarization insensitive reflector can be formed with the conductive members in the forms of L's, T's or other non-symmetrical intersections or that, in some cases no intersection occurs between the transverse arrays. The cruciform arrangement is particularly preferred since the mathematical approximation of the reflection characteristics is simpler than the other mentioned geometries.

SPECIFIC EMBODIMENTS

FIG. 6 illustrates a specific example of radar attenuator constructed according to the principles of this invention. As was mentioned hereinabove, the problem of controlling the electrical properties of attenuator layers at elevated temperatures is particularly acute. The embodiment of FIG. 6 is therefore provided to illustrate application of the principles of this invention to a most difficult situation. The radar attenuator of FIG. 6 is formed of refractory materials resistant to oxidation and therefore capable of use at elevated temperatures.

The innermost layer of the attenuator of FIG. 6 comprises a metal sheet 21, this representation of the innermost metal layer as a sheet is semi-schematic since it may be a conductive sheet or may be a structural member forming a portion of a vehicle, building, or the like from which it is desired to minimize radar reflection. The balance of the structure of FIG. 6 is arrayed between the metal layer 21 and the direction from which an incident radar beam would impinge, as indicated by an arrow 22.

Next, outwardly, from the reflective metal layer 21 is a layer of ceramic foam 23 which, in a preferred embodiment, is about 0.348 inch thick. A ceramic foam suitable for use in practice of this invention comprises a silica foam available under the trade name of Glasrock from the Glasrock Company, Atlanta, Ga. It will be apparent to one skilled in the art that other refractory foams such as $Al_2O_3$ and MgO, or low density tiles, can be employed in place of a silica foam. Another useful foam with good thermal shock resistance comprises zircon ($ZrO_2.SiO_2$) or mullite ($3Al_2O_3.2SiO_2$) particles whipped in an alkali metal silicate slurry. Another ceramic foam material found useful in practice of this invention comprises a ceramic having a dispersion of zirconia and silica powders bound together by sodium silicate. A typical composition comprises about 22% zirconia, about 3% silica and about 75% sodium silicate. Dispersed within this ceramic foam is about 4.5 weight percent of short reinforcing fibers of Kaowool which comprises a ceramic material having about 52% silica, 45% alumina, and the balance $Fe_2O_3$ and $TiO_2$. It will be apparent that other compositions of high temperature ceramic fibers can also be employed. Another ceramic foam composition found useful comprises about 16.5% zirconia, about 1.5% silica, and 82% sodium silicate with about 4% Kaowool fibers dispersed therein. Techniques for forming such ceramic foams in unitary bodies are described in U.S. patent application Ser. No. 665,194, entitled, "Multi-purpose Material", by D. T. Bailey et al, and assigned to North American Rockwell Corporation, assignee of this application. Such foam materials have a dielectric constant of about 2.7.

Next outwardly from the foam layer 23 is a tuned reflective layer 24 which, in a preferred embodiment, has a center frequency of about 5 GHz, and is described in greater detail hereinafter.

Next outwardly from the tuned reflective layer 24 is another foam layer 25 substantially identical to the foam layer 23 and having a thickness of about 0.068 inch. Next outwardly from the foam layer 25 is another tuned or resonant reflector 26 which, in a preferred embodiment, is tuned to have a resonant frequency of about 7 GHz. Next outwardly from the tuned reflective layer 26 is another layer of ceramic foam 27 substantially identical to the ceramic foam layer 23 and having a thickness of about 0.061 inch. Next outwardly from the ceramic foam layer 27 is a tuned reflective layer 28 which in a preferred embodiment, is tuned to have a reflective frequency of about 9 GHz.

A portion of the successive layers of the radar attenuator of FIG. 6 are cut away to expose a portion of the reflective layer 28 which is representative of the other reflective layers 24 and 26. As can be seen in the cutaway portion the reflective layer 28 comprises a surface 29 of the foam layer 27 which forms a nonconductive area in which are arrayed, in columns and rows, a plurality of narrow elongated conductive areas 30 substantially the same as the conductive areas 16 hereinabove described and illustrated in FIG. 2. In a ceramic radar attenuator for elevated temperatures the conductive areas 30 are preferably made of a refractory metal having a melting point substantially above the operational temperature of the ceramic attenuator. It is also desirable to employ a metallic material for the conductive areas 30 that is highly resistant to oxidation to avoid changes in electrical properties upon exposure to elevated temperature. Platinum and related materials are excellent for the highest feasible service, and the areas may be formed by deposition of the metal on the ceramic foam, or pieces of foil may be inserted during assembly of the structure.

The reflective areas in the resonant reflective layers 24, 26 and 28 preferably have dimensions as set forth in Table I wherein S is the center-to-center spacing of the narrow conductive areas in both rows and columns ($Sx=S_y$), d is the width of the conductive areas, and G is the gap between the ends of conductive areas. The bandwidths of each of these layers is about ±22%. With such dimensions and thicknesses of foam layers herein described in relation to FIG. 6, good radar attenuation is obtained over a broad frequency band.

TABLE I (S)

| Frequency GHz | Spacing, S inch | Width, d inch | Gap, G inch |
|---|---|---|---|
| 5 | 1.3 | 0.623 | 0.125 |
| 7 | 0.926 | 0.445 | 0.089 |
| 9 | 0.726 | 0.348 | 0.069 |

Next outwardly from the tuned conductive layer 28 is another layer of ceramic foam substantially identical to the ceramic foam layer 23 and having a thickness of about 0.157 inch. Next outwardly from the ceramic foam layer 31 is an attenuator layer 32 having an impedance approximating that of free space for optimum attenuation of radiation in the manner hereinabove described. The attenuation layer 32 can comprise either conventional spacecloth employing a silica fabric with a dispersion of carbon thereon if adequate oxidation protection is provided or can comprise a layer of dispersed platinum black or silicon carbide providing a suitable characteristic impedance in substantially the same manner as dispersed carbon black in conventional spacecloth. The platinum black is preferred since platinum is highly resistant to oxidation at elevated temperature and can be employed without additional oxidation protection.

Next outwardly from the attenuator layer 32 is another layer of ceramic foam 33 substantially identical to the foam layer 23 and having a thickness of about 0.222 inch. The outermost foam layer 33 upon which radar may impinge provides some electrical tuning between the attenuator layer 32 and free space and to a larger extent affords mechanical and thermal protection for the underlying structure. The outermost foam layer may also be provided, if desired, with a high temperature sealant to inhibit oxidation of underlying materials. Such an oxidation inhibiting sealant is described in U.S. patent application Ser. No. 588.261 entitled "Radar Attenuator For Elevated Temperatures" by W. P. Manning and V. Miller and assigned to North American Rockwell Corporation, assignee of this application.

Another specific example of radar attenuator constructed according to the principles of this invention is illustrated in FIG. 7. As illustrated in this embodiment there is provided an attenuator or spacecloth layer 36 which may, for example, be a fabric coated with a resin in which carbon and metallic particles are dispersed to provide an admittance of about 0.003+j.00045 which serves to attenuate radar reflected thereto in the same manner as spacecloth in a conventional Salisbury screen. The attenuator layer 36 serves as the outer face of the composite attenuator upon which an incident radar beam 35 may impinge. Next inwardly from the attenuator layer 36 is a layer of conventional resin bonded glass fabric honeycomb 37 having a thickness such that a tuned reflective layer 38 therebehind is spaced from the attenuator layer 36 by about 0.381 inch. The first reflective layer 38 is tuned to reflect a narrow band of radiation having a frequency of about 7.7 GHz, and is substantially transparent to radiation of other frequencies. Radiation reflected from the first reflector is absorbed by the attenuator layer 36 as hereinabove described in relation to FIG. 1.

Next inwardly from the reflector 38 is a layer of conventional resin bonded glass fabric honeycomb 39 and next inwardly from the honeycomb is a second tuned reflector 40. The second tuned reflector has a resonant frequency of about 4.4 GHz reflecting radiation in a narrow band at about that frequency and being transparent to other frequencies. The second reflector is spaced behind the attenuator layer 36 about 0.671 inch by the combined thicknesses of the honeycomb layers 37 and 39 and the first reflector 38.

Spaced behind the second reflector 40 is another layer of glass fabric honeycomb 41 serving, with the other layers, to space a third reflector 42 about 0.820 inch behind the attenuator layer 36. The third reflector is tuned to reflect a narrow band spanning a resonant frequency of about 3.6 GHz. The three resonant reflectors, 38, 40, and 42 are, for example, narrow elongated bars of aluminum deposited on thin sheets of Mylar as hereinabove pointed out. The dimensions of the aluminum areas for the reflectors is set forth in Table II.

TABLE II

| Frequency GHz | Spacing, $S_x$ inch | Spacing $S_y$ inch | Width, D inch | Gap, G inch |
|---|---|---|---|---|
| 7.7 | 0.43 | 0.44 | .0275 | 0.04 |
| 4.4 | 0.64 | 0.66 | .0375 | 0.06 |
| 3.6 | 1.06 | 1.10 | .0625 | 0.10 |

Inwardly from the third reflector 42 is a glass fabric honeycomb layer 43 serving to space a metal ground plane 44 behind the attenuator layer 36 a distance of about 1.50 inch. Radiation of lower frequency reflected from the metal ground plane and the selected frequencies reflected from the tuned reflectors is absorbed, as hereinabove described, by the attenuator layer 36 to effect good radar attenuation over a substantial frequency range.

A variation of the invention herein described and illustrated in the previously described embodiments employs a slotted metal sheet for the final layer in the absorbing assembly in lieu of a continuous metal sheet. The slotted metal sheet has reflection of all frequencies of radiation except a narrow band about a frequency to which it is tuned in the same manner as a slotted radome. The slotted metal sheet is transparent at this frequency and therefore the resultant composite structure is transparent to a narrow frequency band and absorptive for other frequencies. Such a structure is useful as a radome for transmitting a communication frequency, for example, and absorbing search and track radar.

Obviously many other modifications and variations of the present invention are possible in light of the above teachings. It is therefore to be understood that within the scope of the appended claims the invention may be practiced otherwise than as specifically described.

What is claimed is:

1. An attenuator of electromagnetic radiation comprising:

an impedance layer having a uniform impedance which is substantially the same impedance as free space, said radiation passing through said layer; and a reflective and transparent layer tuned to reflect a selected frequency of electromagnetic radiation and transmit other frequencies, said reflective and transparent layer being spaced from said impedance layer at a distance of one fourth of the wavelength of electromagnetic radiation of the selected frequency.

2. An attenuator as defined in claim 1 further comprising:

a second reflective layer tuned to reflect a second selected frequency of electromagnetic radiation, said second reflective layer being spaced from said impedance layer at a distance of one fourth of the wavelength of electromagnetic radiation at the second selected frequency and on the same side of said impedance layer as said first reflective layer.

3. An attenuator as defined in claim 1 further comprising:

a plurality of reflective layers, each of said reflective layers being tuned to reflect a selected frequency of electromagnetic radiation, each of said reflective layers being spaced from said impedance layer at a distance of one fourth of the wavelength of electromagnetic radiation at its selected frequency and on the same side of said impedance layer as said first reflective layer.

4. An attenuator as defined in claim 3 wherein each of said reflective layers has a frequency band spanning its selected frequency of less than about ±25% at the 3 db down power level and said frequency bands overlap for providing good attenuation over a broad frequency range.

5. An attenuator as defined in claim 3 wherein at least one of said reflective layers comprises an array of elongated narrow conductive areas arranged in spaced apart columns and rows in a generally non-conductive area.

6. An attenuator as defined in claim 5 wherein said reflective layers are mutually spaced apart by a ceramic foam; and wherein said first reflective layer has conductive areas about 0.623 inch wide in rows and columns with center-to-center spacing of about 1.3 inch and gaps between ends of conductive areas of about 0.125 inch;

a second reflective layer has conductive areas about 0.445 inch wide in rows and columns with center-to-center spacing of about 0.926 inch and gaps between ends of conductive areas of about 0.089 inch; and a third reflective layer has conductive areas about 0.348 inch wide in rows and columns with center-to-center spacing of about 0.726 inch and gaps between ends of conductive areas of about 0.069 inch.

7. An attenuator as defined in claim 5 wherein the dimensions of the array of conductive areas is selected from the graphical relations of FIGS. 3 and 4.

8. An attenuator as defined in claim 1 wherein said reflective layer comprises a plurality of elongated narrow conductive areas arranged in spaced apart columns and rows in a generally non-conductive area.

9. An attenuator as defined in claim 8 wherein said reflective layer comprises a second plurality of elongated narrow conductive areas arranged transverse to said first mentioned conductive areas, none of said second conductive areas being common with more than one of said first conductive areas.

10. An attenuator as defined in claim 8 wherein said conductive areas are formed of refractory metal and said reflective layer is spaced apart from said attenuator layer by a ceramic.

11. An attenuator as defined in claim 8 wherein said reflective layer comprises a plastic sheet having metal conductive areas thereon, and said reflective layer is spaced from said attenuator layer by a honeycomb core.

12. An attenuator as defined in claim 1 wherein said reflective layer comprises a plurality of cruciform conductive areas arranged in spaced apart columns and rows in a generally non-conductive area.

13. An attenuator as defined in claim 1 wherein said reflective layer has a frequency bandwidth of less than about ±25% of the selected frequency of the layer at the 3 db-down reflected power level.

14. A broad band radiation attenuator comprising a plurality of mutually spaced layers including:

a first layer having an impedance substantially the same as the impedance of the medium through which radiation is propagated to the attenuator;

a second layer having an impedance for reflecting incident radiation; and at least a third layer interposed between the first and second layers and having an impedance tuned to reflect a selected frequency of radiation and to transmit radiation of frequencies adjacent said selected frequency, said third layer being spaced from said first layer at a distance of one-fourth of said selected frequency; and said second layer being spaced from said first layer at a distance of one-fourth of a frequency reflected thereby.

15. An attenuator as defined in claim 14 wherein said third layer has a frequency bandwidth spanning said selected frequency of less than about ±25% of the selected frequency at the 3 db-down power level.

16. A broad band attenuator of electromagnetic radiation of radar frequencies comprising:

means for absorbing radiation from the electric field of electromagnetic radiation;

first means for reflecting electromagnetic radiation of a first frequency and transmitting radiation of a second frequency, said first means for reflecting being spaced from said means for absorbing at an effective distance of one fourth of the wavelength of the first frequency;

second means for reflecting electromagnetic radiation of the second frequency and transmitting radiation of other frequencies, said second means for reflecting being spaced from said means for absorbing at an effective distance of one fourth of the wavelength of the second frequency, whereby said means for absorbing can attenuate radiation of the first frequency and of the second frequency.

* * * * *